US006702686B1

(12) United States Patent
Brown

(10) Patent No.: US 6,702,686 B1
(45) Date of Patent: Mar. 9, 2004

(54) SWINGS

(75) Inventor: Barrett W. Brown, Rockport, ME (US)

(73) Assignee: Cedarworks, Inc., Rockport, MA (US)

( * ) Notice: Subject to any disclaimer, the term of this patent is extended or adjusted under 35 U.S.C. 154(b) by 0 days.

(21) Appl. No.: 10/330,393

(22) Filed: Dec. 27, 2002

(51) Int. Cl.[7] ..... A03G 31/08
(52) U.S. Cl. ..... 472/118; 472/125
(58) Field of Search ..... 472/118, 120, 472/121, 122, 123, 124, 125

(56) References Cited

U.S. PATENT DOCUMENTS

| | | | | | |
|---|---|---|---|---|---|
| 182,548 | A | * | 9/1876 | Blakeslee | 472/122 |
| 1,371,197 | A | * | 3/1921 | Couch | 472/124 |
| 2,860,689 | A | | 11/1958 | Baker | 155/17 |
| 3,145,990 | A | | 8/1964 | Prouty | 272/1 |
| 3,838,854 | A | | 10/1974 | Hendrickson | 272/85 |
| 3,937,463 | A | | 2/1976 | Soisson | 272/85 |
| 4,014,540 | A | | 3/1977 | Caulkins | 272/85 |
| 4,417,725 | A | * | 11/1983 | Van Horn | 472/14 |
| 4,569,517 | A | * | 2/1986 | Smith | 472/120 |
| 5,161,522 | A | | 11/1992 | Clevenger | 128/25 |
| 5,649,866 | A | * | 7/1997 | Balwanz | 472/118 |

* cited by examiner

*Primary Examiner*—Kien T. Nguyen
(74) *Attorney, Agent, or Firm*—Fish & Richardson P.C.

(57) ABSTRACT

A play swing is selectively configurable for mounting to swing in different modes of operation, such as swiveling or circling movement and for back-and-forth movement.

10 Claims, 1 Drawing Sheet

SWINGS

TECHNICAL FIELD

This invention relates to swings, e.g., for use in children's play areas.

BACKGROUND

Playgrounds and other play areas for children include various types of swings. Some play areas include what are commonly referred to as "tire swings." Such swings include a seat, which may be a vehicle tire (hence the name of the swing), suspended from an overhead support by flexible suspension lines, typically ropes, chains or cables, with its side surface disposed in a generally horizontal plane. The lines support the seat in a manner to permit the swing to move in all directions, including in a circling motion.

Other types of swings are designed primarily for back-and-forth movement, in an arc through a plane, swinging back and forth about an overhead pivot point in the manner of a pendulum. While these swings can sometimes be rotated or moved in other directions, their mounting does not facilitate such movements.

SUMMARY

The invention features a swing having selectively reconfigurable mounting from an overhead support, for use in different modes of swinging operation. For example, the swing can be selectively mounted for use in a circling mode or a back-and-forth mode. Thus, a single swing can be used for different types of play and can be adapted to the changing preferences of the children using the play area.

In one aspect, the invention features a children's play swing including (a) a plurality of upper suspension lines configured for mounting to an overhead support; (b) a plurality of lower suspension lines suspended from the upper suspension lines; (c) releasable fasteners configured to releasably connect first lower ends of the upper suspension lines to free upper ends of the lower suspension lines, to allow the number and arrangement of the upper suspension lines to be altered to change the mode of operation of the swing; and (d) a seat suspended from lower, second ends of the lower suspension lines.

Some implementations include one or more of the following features. The play swing further includes releasable support fasteners configured for releasable connection of second, upper ends of the upper suspension lines to an overhead support. The seat has a general tireshape. The play swing includes four lower suspension lines. The lower suspension lines are attached to the seat at regularly spaced intervals. The lower suspension lines are attached to the seat at regularly spaced intervals corresponding to quadrants of the seat. The play swing further includes a swivel element releasably connecting lower suspension lines and upper suspension lines. The releasable fasteners include carabiners. The upper suspension lines and the lower suspension lines comprise ropes.

In another aspect, the invention features a method for selectively mounting a play swing for different modes of operation, including the steps of: (a) mounting, to an overhead support, upper ends of upper suspension lines of a swing assembly, the swing being suspended from lower ends of lower suspension lines, the upper ends of the lower suspension lines and lower ends of the upper suspension lines being releasably joined by releasable connectors, (b) for selectively mounting the swing for swinging in a first, back-and-forth mode, joining the upper ends of a first pair of adjacent lower suspension lines to a lower end of a first upper suspension line at a first releasable connector and joining the upper ends of a second pair of adjacent lower suspension lines to a lower end of a second upper suspension line at a second releasable connector, and (c) for selectively mounting the swing for swinging in a second, circling mode, joining the upper ends of the lower suspension lines to the lower ends of the upper suspension lines at a releasable connector.

The details of one or more embodiments of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Figure 1:
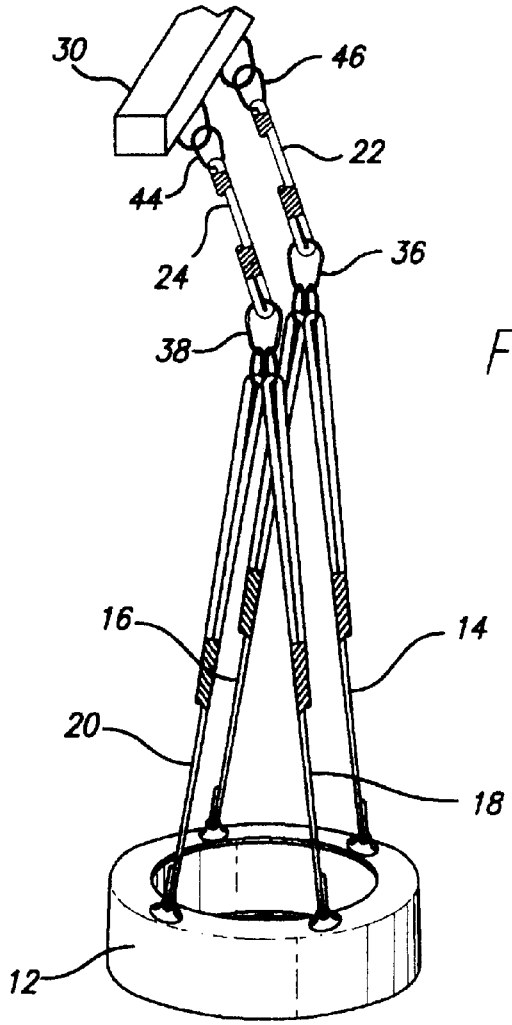
FIG. 1 is a perspective view of a swing with reconfigurable mounting according to one embodiment of the invention, selectively mounted for use in "back-and-forth mode."
Figure 2:
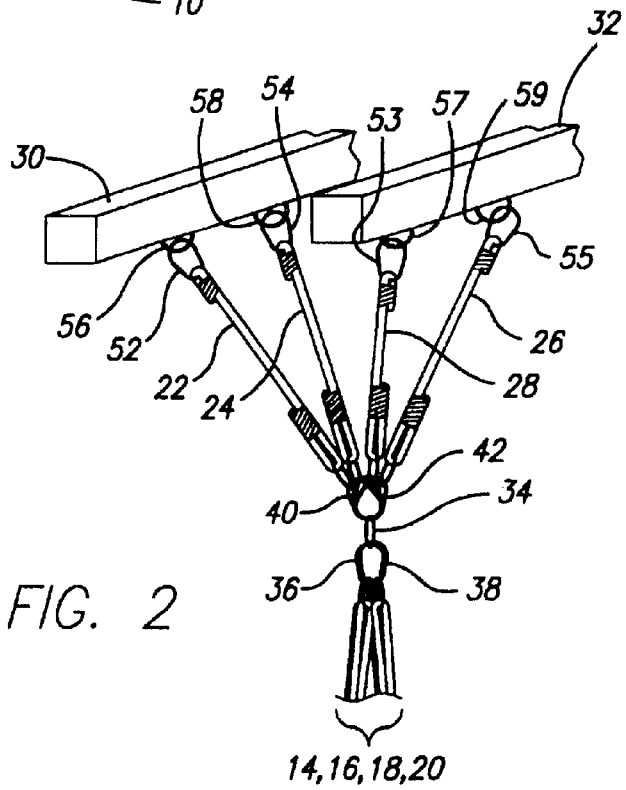
FIG. 2 is a partial perspective view of the swing shown in FIG. 1, selectively mounted for use in "circling" mode.

FIGS. 1 and 2 illustrate one embodiment of a children's play tire swing with reconfigurable mounting that permit selective operation in a back-and-forth mode and in a circling or swivel mode.

A play tire swing 10 of the invention consists of a molded "tire" seat 12 mounted in horizontal position from four lower suspension ropes 14, 16, 18, 20 attached at quadrants of the seat. The lower suspension ropes are suspended, e.g., from one, two or four, upper suspension ropes 22, 24, 26, 28 that are in turn are suspended from one or more overhead support bars, as will be discussed below. The lower suspension ropes may be selectivelyjoined to the upper suspension ropes in configurations, to allow the tire swing to be used in different modes of swinging operation. To allow reconfiguration of the tire swing between these modes of operation, the lower suspension ropes are releasably joined to the upper ropes, e.g., using carabineers 36 and 38 (FIG. 1), and 40 and 42 (FIG. 2). If desired, e.g. for safety reasons, the carabineers may be of the locking type. Other types of releasable clips or fasteners may be employed.

Referring to FIG. 1, when the play tire swing 10 is to be mounted for back-and-forth swinging motion, the two upper suspension ropes 22, 24 are mounted at positions spaced along a support bar 30, e.g., using carabineers 44, 46 and mounts 48, 50. The upper ends of a first pair of adjacent lower suspension ropes 14, 16 at one side of the tire 12 are then joined to a first upper suspension rope 22, and the upper ends of a second pair of adjacent lower suspension ropes 18, 20 at the opposite side of the tire 12 are joined to a second upper rope 24.

Referring to FIG. 2, when the play tire swing 10 is to be mounted for swivel or circling motion, upper suspension ropes 22, 24 are mounted at positions spaced along the support bar 30, e.g., using carabineers 52, 53, 54, and 55, and mounts 56, 57, 58 and 59. Upper suspension ropes 26, 28 are mounted at positions spaced along a second support bar 32, generally parallel to the positions of upper ropes 22,

24 along the support bar 30. The lower ends of all the upper ropes 22, 24, 26, 28 are then gathered, and joined to the gathered upper ends of the lower suspension ropes 14, 16,18, 20 at a center swivel connection 34.

Embodiments of the invention have been described above. It will be understood that various modifications may be made without departing from the spirit and scope of the invention.

For example, in the circling mode of operation, a single upper rope or two upper ropes may be employed, with the upper ends of the four lower suspension ropes gathered at a swivel connection attached at the lower end or ends of the upper rope(s). Also, chains, cables, or other types of lines may be used to support the seat, rather than ropes. Additionally, while two modes of operation, swivel and back-and-forth, have been shown and described above, the swing may be selectively configured for other modes of operation. Finally, while the seat is shown and described above as being generally tire-like (the seat may be an actual tire or may be molded to look like a tire), the seat may have a different appearance, if desired.

Accordingly, other embodiments are within the scope of the following claims.

What is claimed is:

1. A children's play swing comprising a plurality of upper suspension lines configured for mounting to an overhead support;

a plurality of lower suspension lines suspended from the upper suspension lines; and releasable fasteners configured to releasably connect first lower ends of the upper suspension lines to free upper ends of the lower suspension lines, to allow the number and arrangement of the upper suspension lines to be altered to change the mode of operation of the swing; and a seat suspended from lower, second ends of the lower suspension lines.

2. The play swing of claim 1 further comprising releasable support fasteners configured for releasable connection of second, upper ends of the upper suspension lines to an overhead support.

3. The play swing of claim 1 wherein the seat has a general tire-shape.

4. The play swing of claim 3 wherein the lower suspension lines are attached to the seat at regularly spaced intervals corresponding to quadrants of the seat.

5. The play swing of claim 1 comprising four lower suspension lines.

6. The play swing of claim 1 wherein the lower suspension lines are attached to the seat at regularly spaced intervals.

7. The play swing of claim 1 further comprising a swivel element releasably connecting lower suspension lines and upper suspension lines.

8. The play swing of claim 1 wherein the releasable fasteners comprise carabiners.

9. The play swing of claim 1 wherein the upper suspension lines and the lower suspension lines comprise ropes.

10. A method for selectively mounting a play swing for different modes of operation, comprising the steps of:

mounting, to an overhead support, upper ends of upper suspension lines of a swing assembly, the swing being suspended from lower ends of lower suspension lines, the upper ends of the lower suspension lines and lower ends of the upper suspension lines being releasably joined by releasable connectors, for selectively mounting the swing for swinging in a first, back-and-forth mode, joining the upper ends of a first pair of adjacent lower suspension lines to a lower end of a first upper suspension line at a first releasable connector and joining the upper ends of a second pair of adjacent lower suspension lines to a lower end of a second upper suspension line at a second releasable connector, and for selectively mounting the swing for swinging in a second, circling mode, joining the upper ends of the lower suspension lines to the lower ends of the upper suspension lines at a releasable connector.

* * * * *